US008079096B2

(12) United States Patent
Roberts

(10) Patent No.: US 8,079,096 B2
(45) Date of Patent: Dec. 20, 2011

(54) SELF-CONTAINED, PORTABLE, NON-MECHANICAL WASTE DISPOSAL SYSTEM

(76) Inventor: R. Brett Roberts, Birmingham, AL (US)

( * ) Notice: Subject to any disclaimer, the term of this patent is extended or adjusted under 35 U.S.C. 154(b) by 1098 days.

(21) Appl. No.: 11/974,938

(22) Filed: Oct. 17, 2007

(65) Prior Publication Data

US 2009/0100585 A1 Apr. 23, 2009

(51) Int. Cl.
*A47K 4/00* (2006.01)
*E03D 1/00* (2006.01)

(52) U.S. Cl. ..... 4/476; 4/462; 4/317; 52/36.1; 52/79.1

(58) Field of Classification Search ..... 4/317–318, 4/460–462, 476–479, 449; 52/34–35, 36.2, 52/79.1

See application file for complete search history.

(56) References Cited

U.S. PATENT DOCUMENTS 3,423,766 A * 1/1969 Eger ..... 4/317
3,601,821 A * 8/1971 Corsiglia ..... 4/300
3,629,874 A * 12/1971 Beller ..... 4/462
4,305,164 A * 12/1981 Sargent et al. ..... 4/462
4,682,533 A 7/1987 Hafner et al.
4,888,832 A 12/1989 Cameron
4,947,491 A 8/1990 Parkinson et al.
5,282,281 A * 2/1994 Clear et al. ..... 4/434
5,398,465 A * 3/1995 Tagg ..... 52/79.1
5,500,960 A 3/1996 Tagg
5,913,610 A * 6/1999 Duck ..... 4/321
6,370,706 B1 4/2002 Walraven
6,438,902 B1 * 8/2002 Muller ..... 52/79.1
6,507,958 B1 * 1/2003 Tagg ..... 4/321
6,615,414 B2 * 9/2003 Miller et al. ..... 4/321
6,721,967 B2 * 4/2004 Braxton ..... 4/664
2009/0211002 A1 * 8/2009 Norgaard ..... 4/111.1

* cited by examiner

*Primary Examiner* — Winnie Yip
(74) *Attorney, Agent, or Firm* — Wm. Randall May

(57) ABSTRACT

A portable, self-contained, toilet and sanitation system is disclosed. The system utilizes gravity and non-mechanical means to actually "flush" human bodily waste into a septic storage tank for later removal and disposal and contains sufficient water supply and storage capacity to allow the system to be used continuously for over eight hours. The system is a closed design and operates substantially as a permanent toilet wherein waste odors are trapped and then vented to the atmosphere.

3 Claims, 11 Drawing Sheets

SELF-CONTAINED, PORTABLE, NON-MECHANICAL WASTE DISPOSAL SYSTEM

FIELD OF THE INVENTION

This invention relates generally to collection and disposal systems for human bodily waste. More particularly, the present invention relates to a new and improved portable toilet and sanitation system wherein non-mechanical means are used to flush, collect and store human waste for subsequent removal and disposal.

BACKGROUND OF THE INVENTION

If asked to name the single invention that has most profoundly affected modern civilization, one would have to consider the invention of the "toilet" to be among the top choices. Without the toilet, high-density cities would not have been possible and without the "portable toilet", industrial, commercial and residential development would not be where it is today.

According to historical records, the portable toilet industry had its beginnings in the 1940's in the ship building yards around Long Beach, Calif. Laborers working on ships had to go to the shore or dock each time they had the need to use a toilet. It was eventually recognized by the ship builders that there was a great cost associated with workers having to go so far to simply use a toilet. To address this problem, a transportable wooden cabana containing a small holding tank was constructed and the first "portable toilet" was thus born. This unique concept soon spread to the construction industry and to organizers of large crowd events. While these first "portable toilets" were indeed cost effective in terms of worker productivity, they also had certain disadvantages. Since the first portable toilets were constructed of wood and metal, they were very heavy and thus, difficult to transport. Unfortunately, these first units also absorbed odors associated with the use of the units and were very difficult to keep clean and sanitary.

In the early 1970's, portable toilets made of fiberglass were introduced. These fiberglass toilets were lighter than wood and were therefore much easier to transport, however, they required more maintenance due to the brittle nature of the fiberglass material. In addition, the fiberglass material also absorbed odors from within the cabana and holding tank, thus quickly proving to be a poor choice of material for this purpose.

In the mid-1970's, portable toilets constructed of polyethylene were introduced. The use of polyethylene made portable toilets even more lightweight and durable. Also, since polyethylene, or "plastic", is a non-porous and non-absorbing material, portable toilets constructed of this material were easier to clean and were not quite as offensive to the olfactory senses of the user or patron.

However, throughout the evolution of the portable toilet, one thing has remained constant—its basic design. The basic design for portable toilets has not changed since inception. Today's portable toilet remains essentially that of a self-contained, transportable "outhouse" constructed of molded plastic produced in a variety of colors. In many cases, chemicals have been added to the portable toilet's holding tank in an attempt to mask the foul odor and stench associated with these portable "outhouses". However, the hard truth is that portable toilets of today either smell like strong chemicals or human waste, or a foul combination thereof. Even on a mild day, the odor within, or even near, these portable units can be so overpowering that it becomes virtually unbearable. Vent stacks have been added in some instances in an attempt to draw, or to allow to escape, some of the foul odors emanating from these units. Unfortunately, since these units employ open "outhouse type" designs, the addition of a vent stack to the unit does very little to help with the odor problem.

It would be expedient, therefore, to provide a new and improved portable toilet and sanitation system employing non-mechanical means for effectively flushing, collecting and storing human waste and employing a closed system design for effectively eliminating offensive odors.

SUMMARY OF THE INVENTION

In view of the foregoing, it is a primary object of this invention to provide method and apparatus for a new and improved portable toilet and sanitation system whereby non-mechanical means are used to flush, collect and store human bodily waste.

According to an embodiment of the invention, a self-contained, portable, non-mechanical, closed system design, waste disposal system comprises a housing component which doubles as a compartmented water supply tank, a vented septic tank having expanded storage capacity in the form of a modified truncated pyramid, a flushable, gravity-fed commode component, a flushable, gravity-fed urinal component, and a gravity-fed lavatory component. The commode, urinal and lavatory components are all provided with sanitary siphons or "p-traps" that prevent odors from entering the housing from the attached septic tank.

An important advantage of the present invention is the provision of a portable waste disposal system that operates substantially as a permanent toilet wherein waste odors are trapped and then vented to the atmosphere and where the toilet, urinal and lavatory components are designed to actually "flush" the waste into a holding tank for later removal and disposal.

Another important advantage of the present invention is the provision of an economical and efficient portable waste disposal system that is constructed entirely of molded plastic and has no mechanical parts to replace, repair or maintain.

Another advantage of the present invention is the provision of a portable waste disposal system wherein a water supply means is incorporated into, and is an integral component of, the unit's housing structure.

A further advantage of the present invention is the provision of a portable waste disposal system wherein said water supply means comprises a compartmented tank which contains enough storage capacity to allow the system to be used continuously over an eight and one-half hour period (calculated on the basis of one flush every 5 minutes).

Another advantage of the present invention is the provision of a portable waste disposal system wherein the waste containment and storage capacity of the unit is sufficient to allow the system to be used continuously over an eight and one-half hour period (calculated on the basis of one flush every 5 minutes).

A further advantage of the present invention is the provision of a portable waste disposal system wherein the toilet flushing mechanism is activated by compressing or pushing the forward wall of the toilet's semi-rigid plastic supply tank.

Another advantage of the present invention is the provision of a portable waste disposal system wherein sifting bulbs are used to flush or activate the urinal and lavatory components of the unit.

Another advantage of the present invention is the provision of a fully functional, totally non-mechanical, portable waste disposal system which requires no external water supply and/or pumps for proper operation.

A further advantage of the present invention is the provision of a maintenance free portable waste disposal system wherein there are no bolts, nuts, screws, pumps, levers, springs, hinges, chains, flappers or other mechanical devices necessary for proper operation of the system.

Another advantage of the present invention resides in the simplistic design of the method and apparatus comprising the system wherein gravitational forces are used to provide the water pressure necessary to effectively operate the various sanitary components of the system.

A further advantage of the present invention resides in the closed design of the system wherein foul odors are caused to be contained within the system and are then vented to the atmosphere.

Another advantage of the present invention is the provision of a portable waste disposal system that does not require the use of chemicals or chemically treated sanitation liquids.

A further advantage of the present invention is the provision of additional waste storage capacity in the form of a modified truncated pyramid which is incorporated into the design of the unit and which also provides additional stability for the unit.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
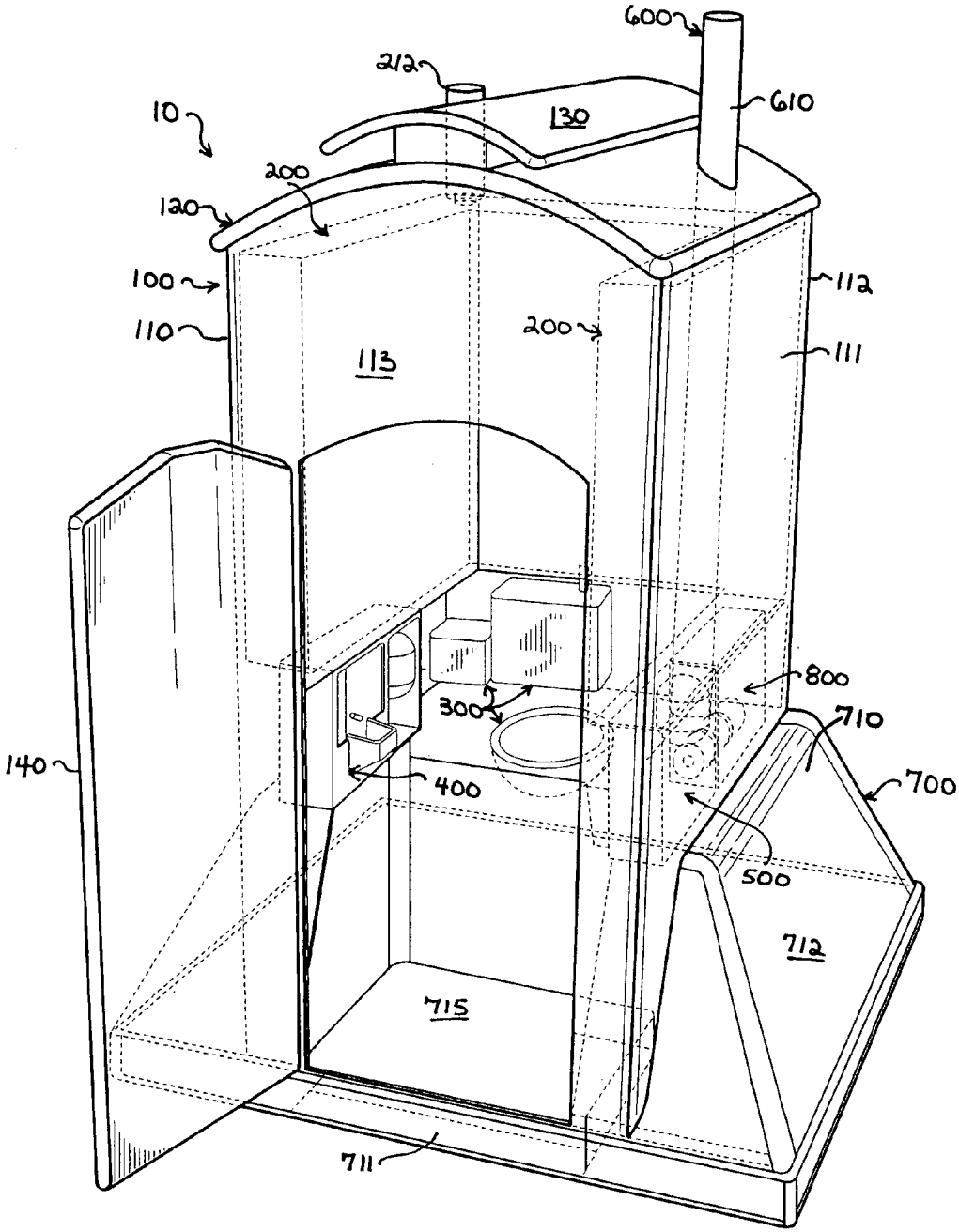
FIG. 1 is a perspective view of a preferred embodiment of the invention showing the various components comprising same.

In accordance with an embodiment of the invention, FIG. 1 shows a fully assembled, self-contained, portable toilet and sanitation system 10. The system 10 comprises a housing component 100, a water supply component 200, a commode component 300, a urinal component 400, a lavatory component 500, a septic vent component 600, a waste storage component 700 and a sanitary supply component 800.

The housing component 100 comprises a cabana-type structure 110. Said cabana structure 110 being constructed of rigid molded plastic and being of sufficient height, length and width to accommodate at least one person in a standing or sitting position. The cabana structure 110 comprises two side walls 111, a rear wall 112 and a front or entry wall 113. The front wall 113 further comprises an entry door 140 operably situated within said wall 113. The cabana 110 further comprises a roof component 120 complete with a venting means 130 extending along the apex or crown of said roof component 120; said venting means 130 being designed to facilitate the natural movement of air through said cabana structure 110. The housing component 100 is attached to, and is supported by, the waste storage component 700 of the system 10. The walls 111, 112 & 113 of said cabana structure 110 are shown in the drawings as being linear in their construction, however, it will be understood that said walls 111, 112, & 113 may also be non-linear in construction.

Figure 2:
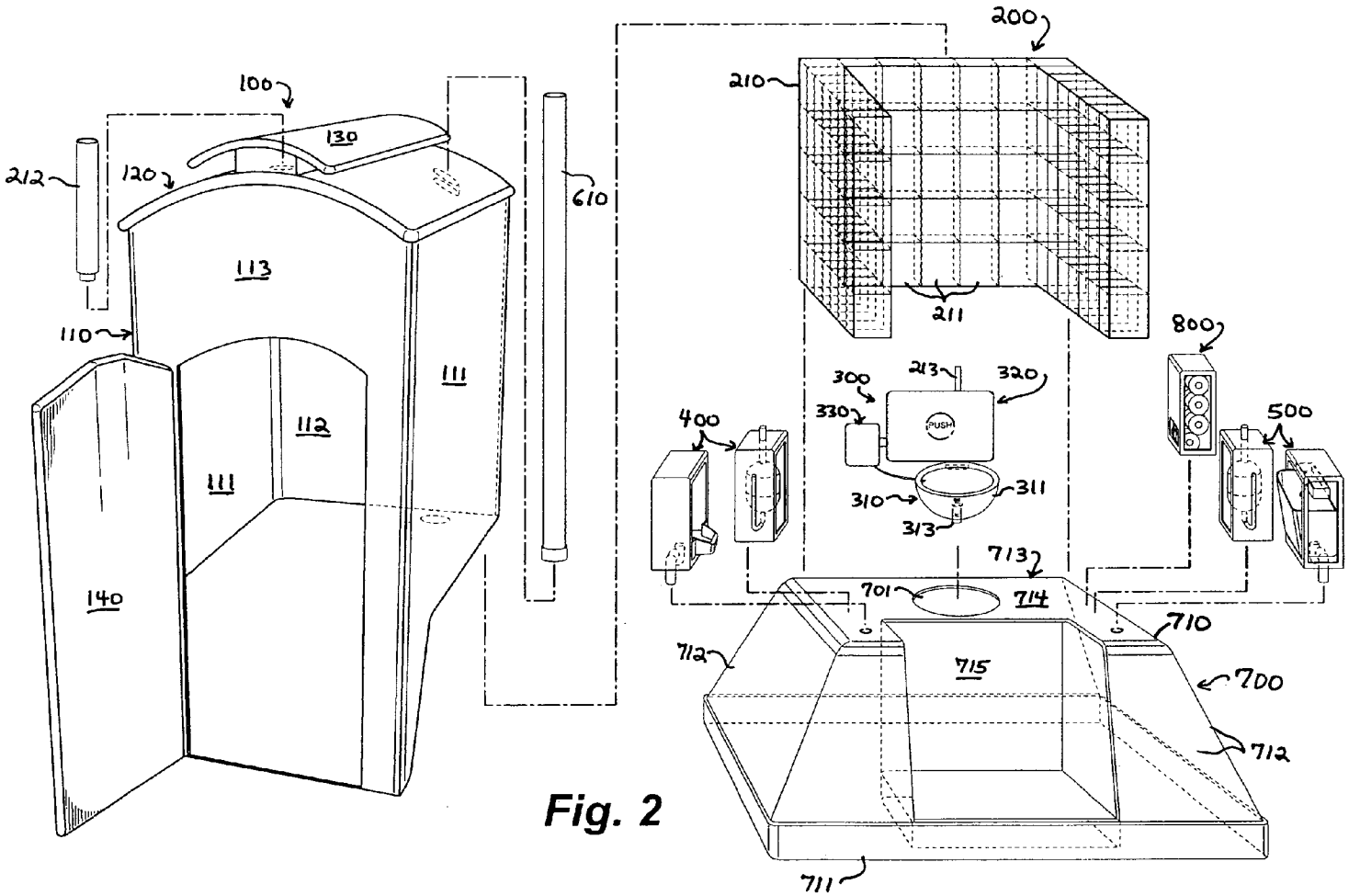
FIG. 2 is an exploded perspective view of the embodiment of FIG. 1 showing the various components of the invention.
Figure 3:
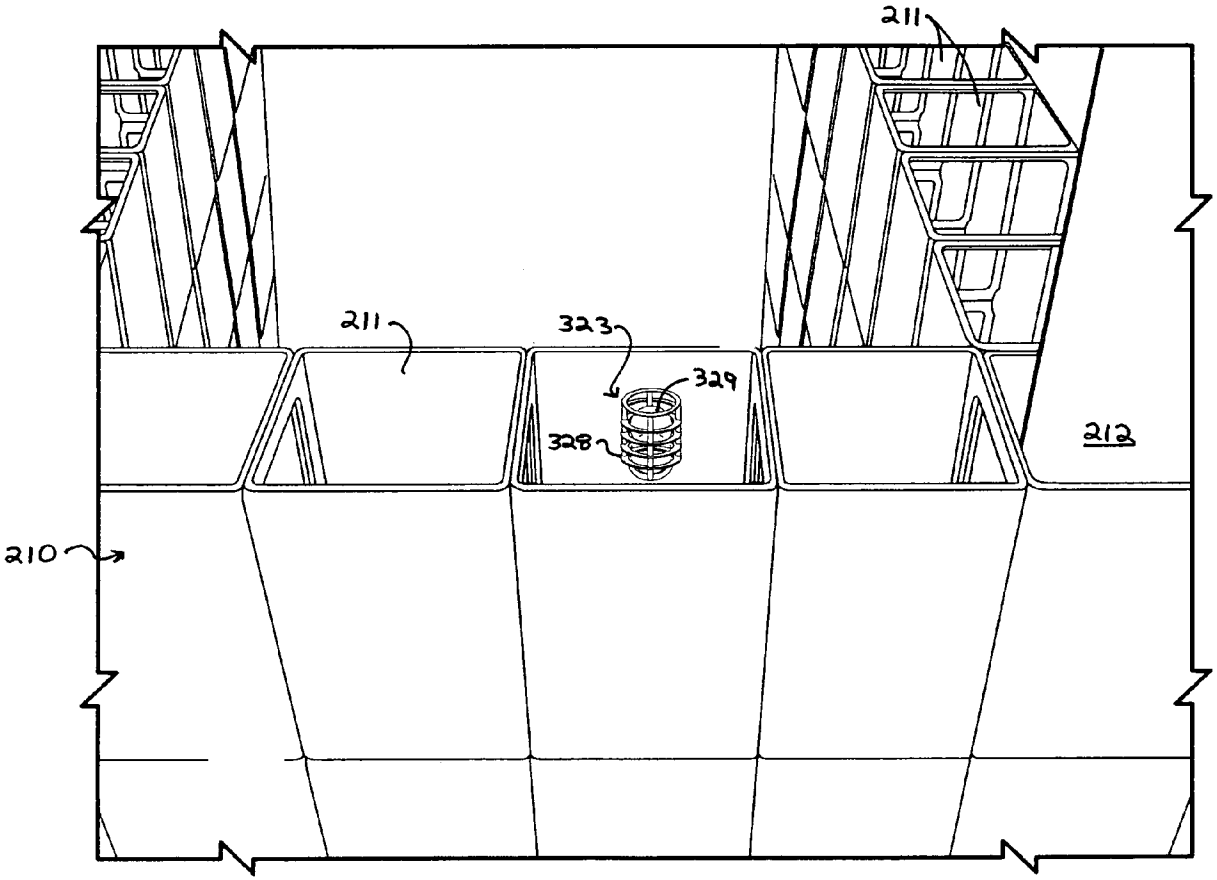
FIG. 3 is a perspective, partially sectioned, enlarged view of the compartmented water supply tank, shown without the housing skin attached, and water supply tank float of the embodiment of FIG. 1.

The water supply component 200 of the system 10, as best seen in FIGS. 2 & 3, comprises a U-shaped tank member 210. Said tank member 210 is attached to, and is an integral component of, the side and rear walls 111 & 112 of said cabana structure 110 as shown. The tank member 210 is constructed of rigid molded plastic and comprises a plurality of ribbed compartments 211 for holding a large volume of water. The ribbed compartments 211 also provide strength and structural integrity to the side and rear walls 111 & 112 of the housing component 100 of the system 10. A fill spout 212 for refilling said tank 210 with water, as needed, is attached to said tank member 210 and extends vertically from said tank member 210 through the roof component 120 of the cabana structure 110.

Figure 4:
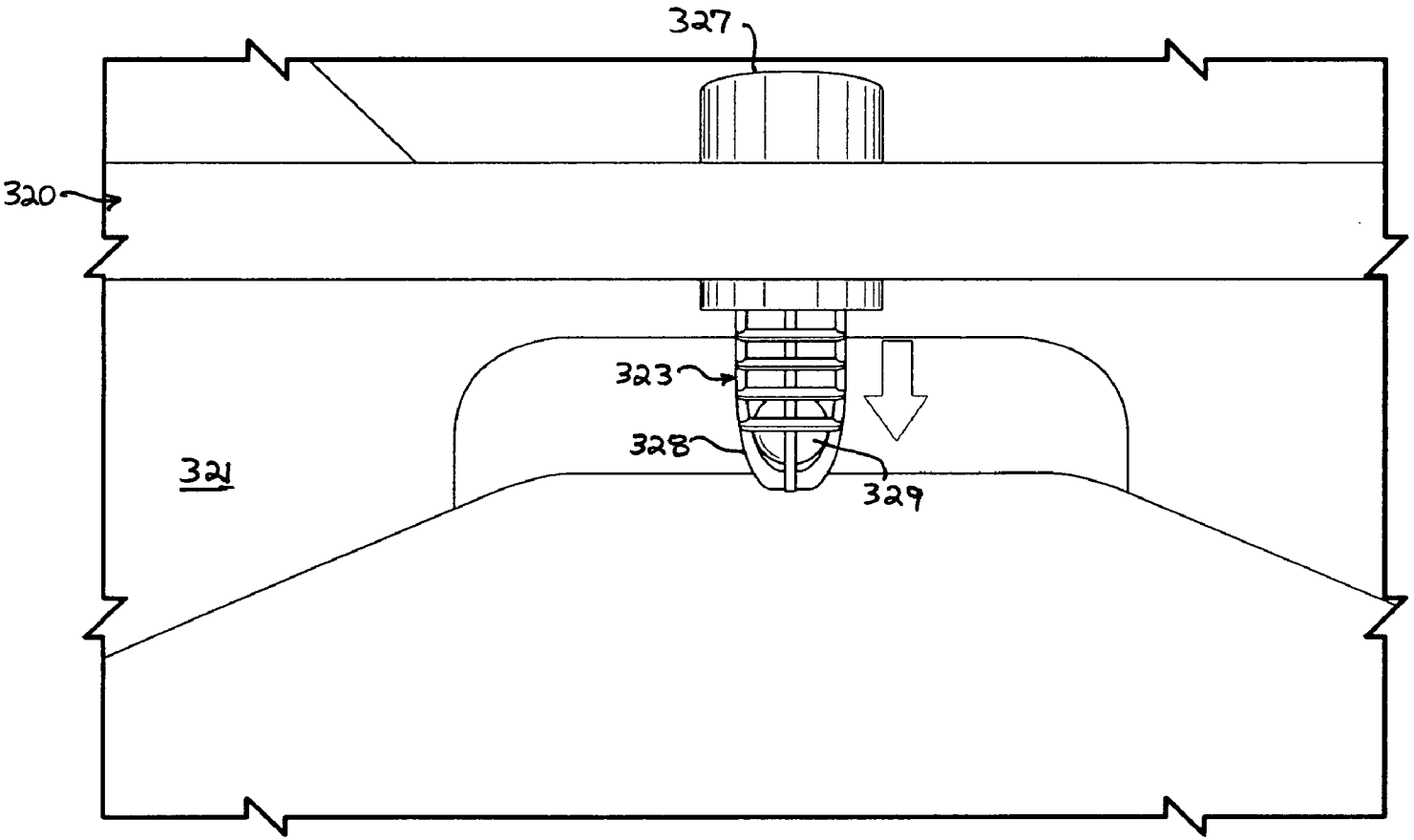
FIG. 4 is a perspective, partially sectioned, enlarged internal view of the commode supply tank of the embodiment of FIG. 1 showing the commode tank float in a disengaged configuration during a flush cycle.
Figure 7:
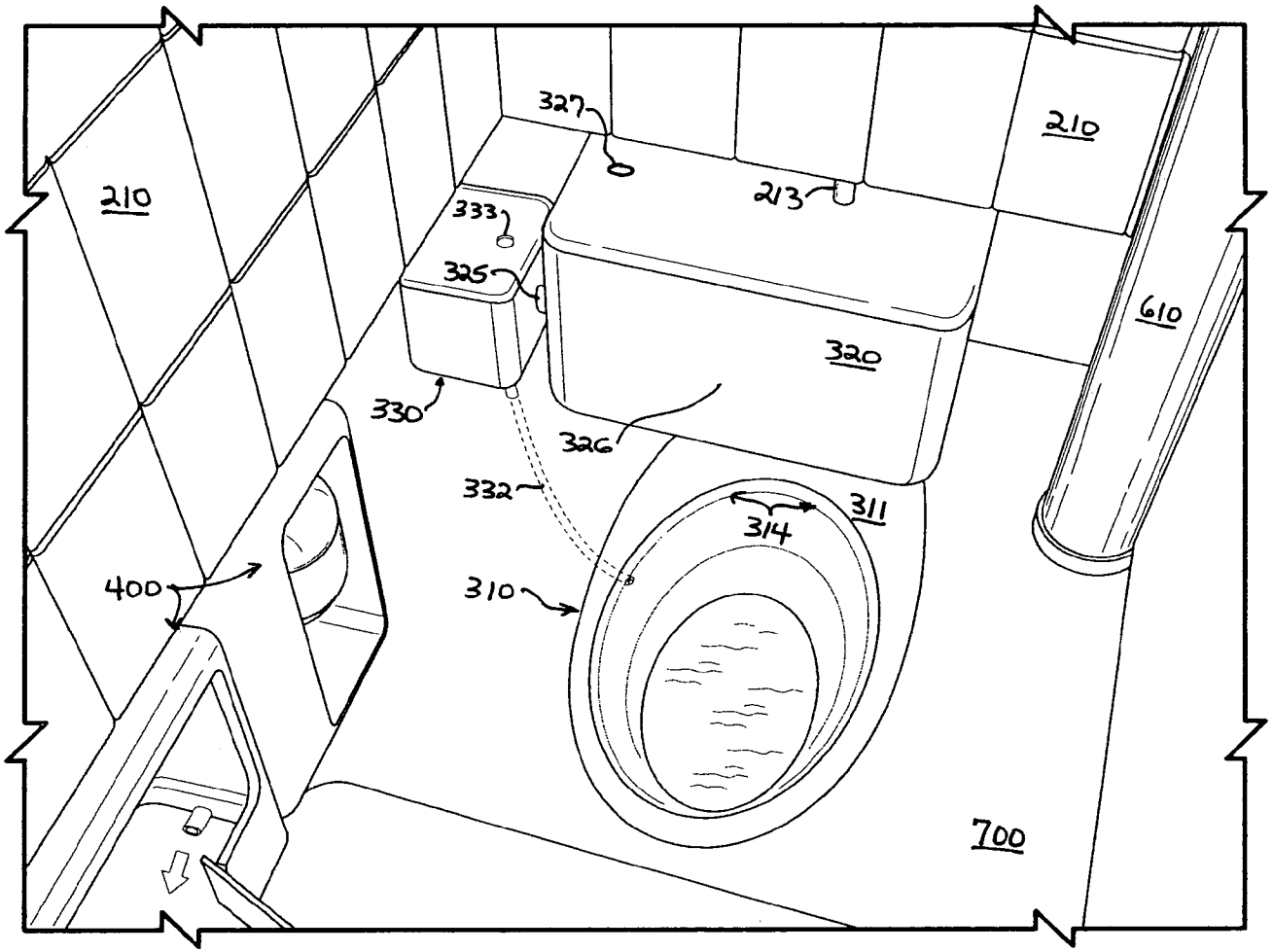
FIG. 7 is an overhead prospective view of the embodiment of FIG. 1 showing the commode and urinal components of the invention and showing the (skinless) compartmented water supply tank and septic vent pipe of the invention.
Figure 8:
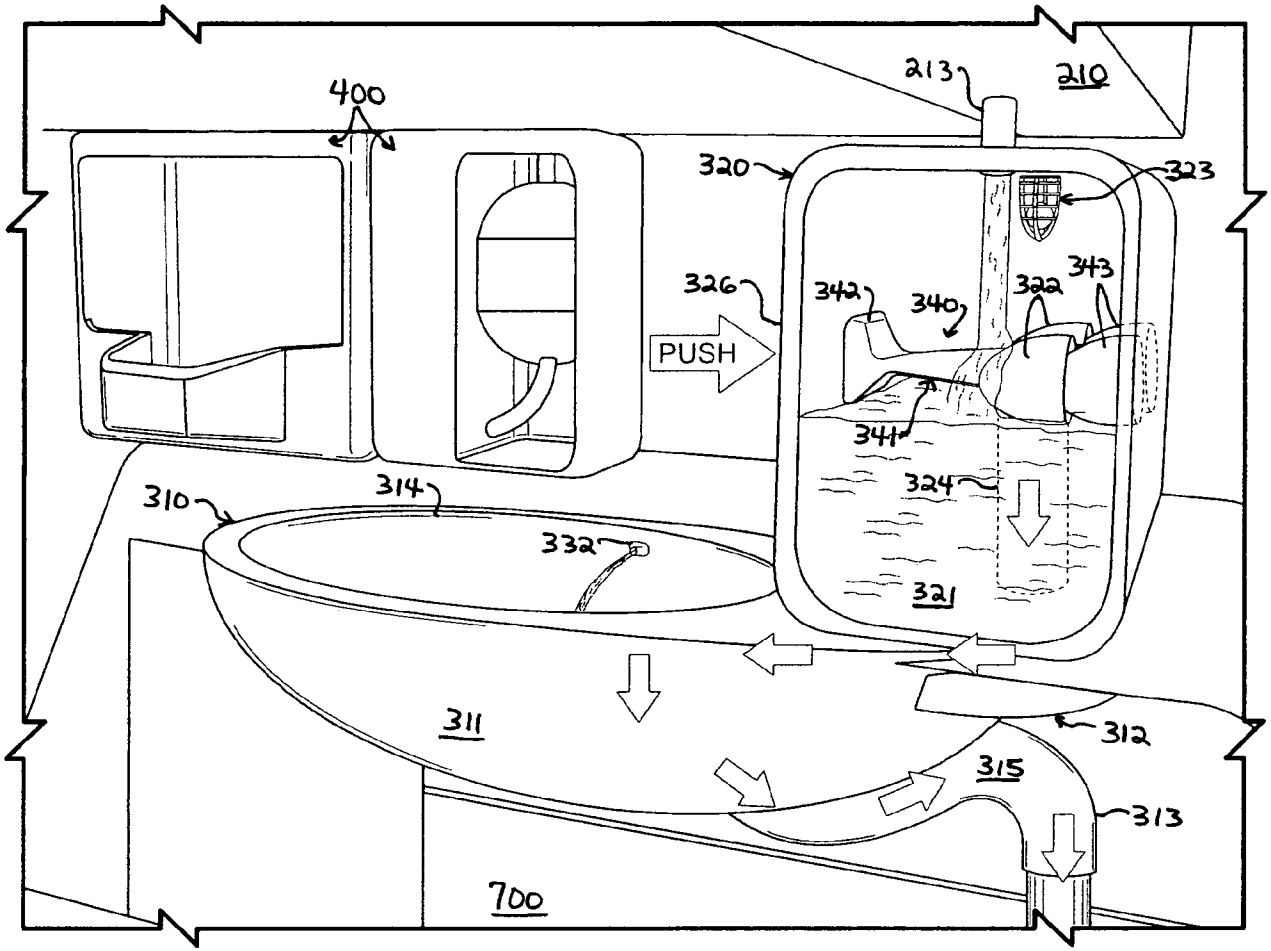
FIG. 8 is a perspective, partially sectioned, view of the commode component and urinal component of the embodiment of FIG. 1 showing the directional flow of water through the commode component during a toilet flush cycle.
Figure 9A:
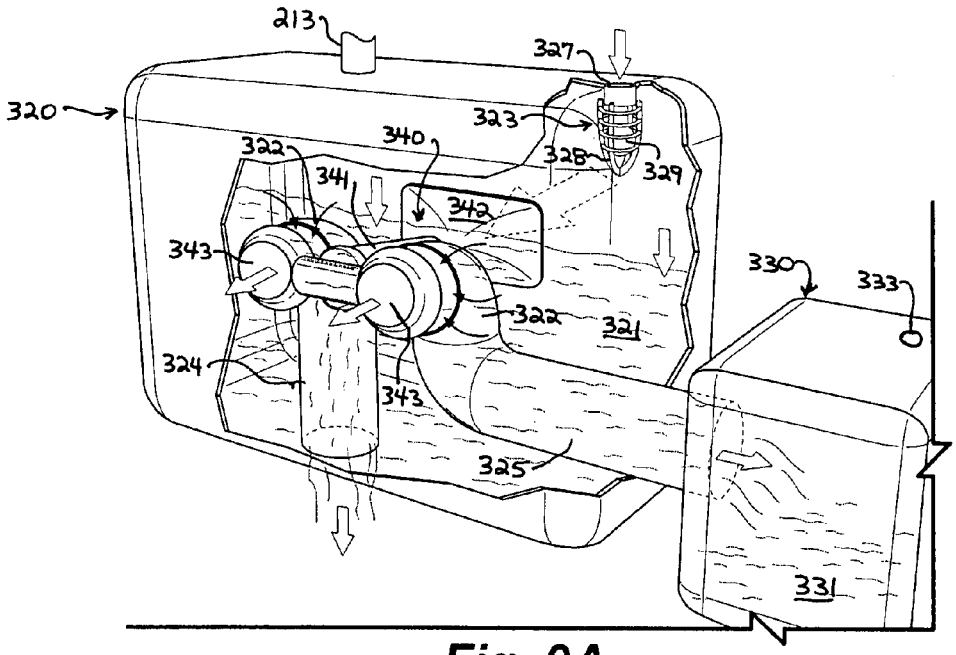
FIG. 9A is a perspective, partially sectioned, view of the tank, flush valve assembly and reservoir of the commode component of the embodiment of FIG. 1 showing the flow of water through the tank, flush valve assembly and reservoir after a flush cycle has been initiated.
Figure 9B:
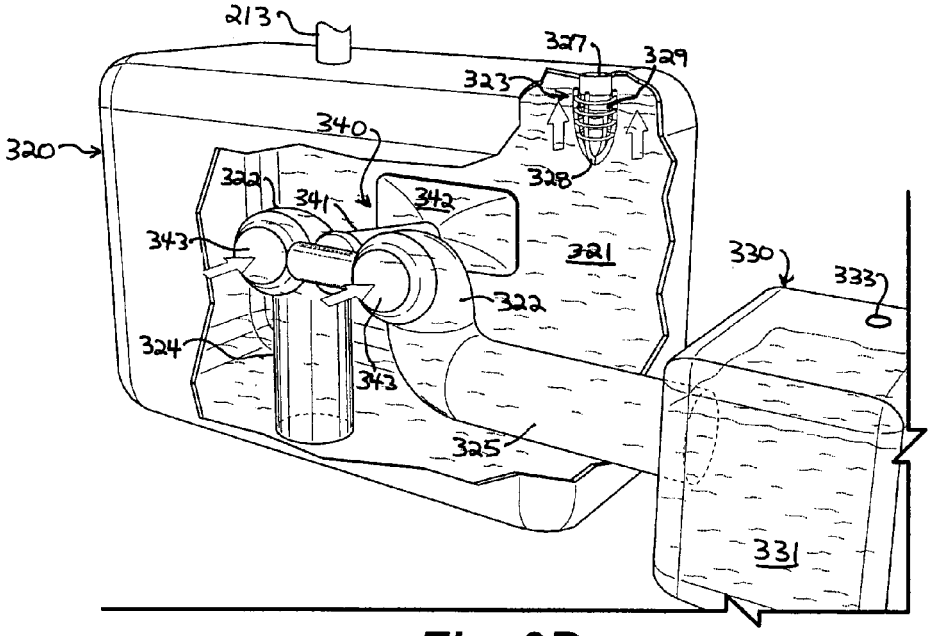
FIG. 9B is a perspective, partially sectioned, view of the tank, flush valve assembly and reservoir of the commode component of the embodiment of FIG. 1 shown after a flush cycle has been completed and the system is ready for another cycle.

The commode component 300 of the system 10, as best viewed in FIGS. 2, 7 & 8, comprises a commode unit 310, a commode supply tank 320, a commode reservoir tank 330 and a flush valve assembly 340 (see FIG. 8). The commode unit 310 comprises a detachable receptacle or bowl 311 for receiving human waste and is removeably and operably attached to the waste storage component 700 of the system 10. The bowl 311 is constructed of rigid lightweight plastic and further comprises a means 312 for receiving a volume of water from the commode supply tank 320 during a flush cycle, an upper internal rim component 314 for directing said volume of water from said commode supply tank 320 along the internal surface of said bowl 311, and a means 313 for delivering the volume of water received from said commode supply tank 320, along with any waste contained in said bowl 311, to the waste storage component 700. In the present embodiment, the means 313 for delivering wastewater from said bowl 311 to said storage component 700 comprises a typical sanitary siphon or "p-trap" pipe assembly 315 attached to the underside of said bowl 311 as shown in FIG. 8. Referring now to FIG. 8, the means 312 for receiving a volume of water from the commode supply tank 320 comprises a commode supply line or pipe 324 emanating from within said commode supply tank 320. Said commode supply pipe 324 being of sufficient diameter to enable a predetermined quantity of water to enter the upper internal rim 314 of said bowl 311 in order to effectively remove waste from said bowl 311 during a flush cycle. As can be best seen in FIGS. 9A & 9B, the commode reservoir tank 330 comprises a small enclosed chamber 331 for receiving a predetermined amount of water from the commode supply tank 320 during a flush cycle. Water is provided to the commode reservoir tank 330 through a reservoir supply line or pipe 325 connected directly to said commode supply tank 320. Water from the reservoir tank 330 is used to refill the commode bowl 311 after the initiation of a flush cycle via a small tube 332, as shown in FIG. 7, emanating from the bottom of said reservoir chamber 331 of said tank 330 and terminating at a point near the upper internal rim 314 of said bowl 311. A small air vent 333 is situated along the top of the reservoir tank 330 in order to allow the free flow of water from the reservoir chamber 331 of said tank 330 through said reservoir tube 332 to the commode bowl 311. The commode supply tank 320 is constructed of semi-rigid molded plastic and has a flexible front wall 326. Said supply tank 320 comprises an enclosed chamber 321 for receiving and holding a predetermined volume of water supplied from the U-shaped tank member 210 of the water supply component 200, and for operably housing the flush valve assembly 340. The flush valve assembly 340 of said commode component 300, as shown in FIGS. 8, 9A & 9B, comprises an activator piston 341 having a base component 342 attached at one end of said activator piston 341 and a pair of cone-shaped valve members 343 attached at the opposing end of said piston 341. The base component 342 of said activator piston 341 is attached to the flexible front wall 326 of said commode supply tank 320. The cone-shaped valve members 343 are situated at either side of said activator piston 341 and are designed to simultaneously and operably engage and disengage the commode supply line 324 and the reservoir supply line 325 of said commode component 300 so as to allow a predetermined amount of water to enter said supply lines 324 & 325 during a flush cycle. The commode supply tank 320 further comprises a venting means 323, as shown in FIGS. 4, 9A & 9B, for allowing air to enter and leave the commode tank chamber 321 during a flush cycle. The venting means 323 is disposed internally of said chamber 321 and comprises a cage means 328 attached to a vent opening 327 situated at the top of said chamber 321. Said cage means 328, as best viewed in FIG. 4, further comprising a float ball 329 situated within said cage means 328 which rises with the level of water inside the chamber 321 of said supply tank 320 so that when the supply tank 320 is full, the float ball 329 stops the flow of air through said vent opening 327 thus creating a pressure lock and thereby stopping the flow of water into said chamber 321 from said water supply tank 210. During a flush cycle, water is received by the commode tank chamber 321 from the U-shaped tank 210 of said water supply component 200 through a water supply line 213 located at the top of said chamber 321. Upon activation of the flush valve assembly 340, water is delivered from the commode tank chamber 321 to the commode unit 310 and to the commode reservoir tank 330 through the flush valve assembly 340 via the commode supply line 324 and the reservoir supply line 325, respectively. The commode supply line 324 and the reservoir supply line 325 originate from within the commode supply tank 320 and have open flared ends 322 for effectively engaging the cone-shaped valve members 343 of said flush valve assembly 340. In order to initiate a commode flush cycle, a patron or user activates the flush valve assembly 340 by pressing inwardly against the flexible front wall 326 of the commode supply tank 320. Pressure against said flexible front wall 326 causes the activator piston 341 of said flush valve assembly 340 to move laterally thereby causing the cone-shaped valve members 343 attached to the opposing end of said activator piston 341 to disengage, or move laterally away from, the flared ends 322 of the commode supply line 324 and the reservoir supply line 325. This action allows a predetermined volume of water to enter the commode unit 310 and the commode reservoir tank 330 thereby flushing any waste contained in the commode bowl 311 out of said bowl 311 and into the waste storage component 700 and thereby refilling said bowl 311 with a predetermined amount of water from the commode reservoir tank 330 in preparation for the next flush cycle.

Figure 5:
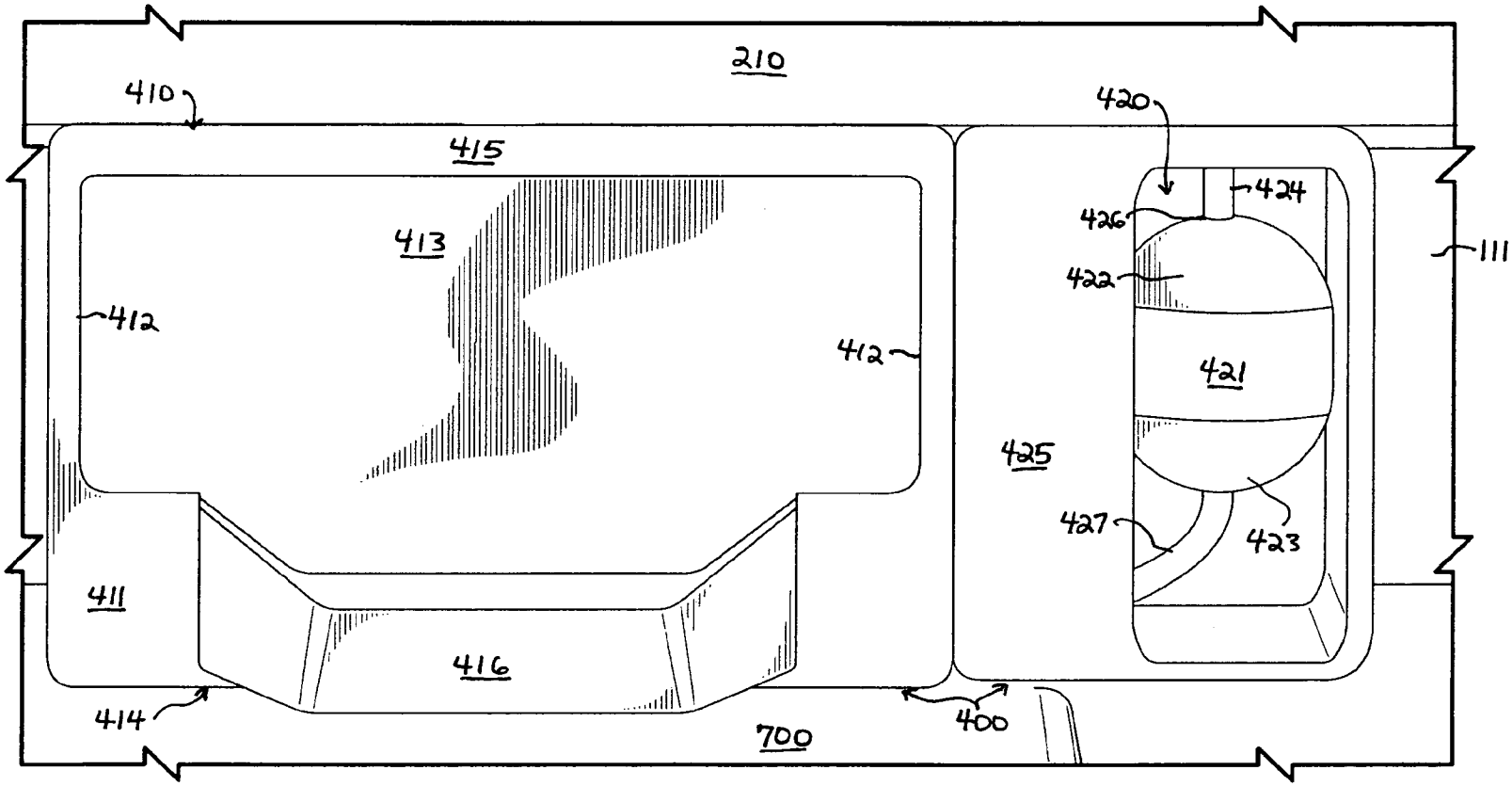
FIG. 5 is a prospective view of the urinal component of the embodiment of FIG. 1.
Figure 6:
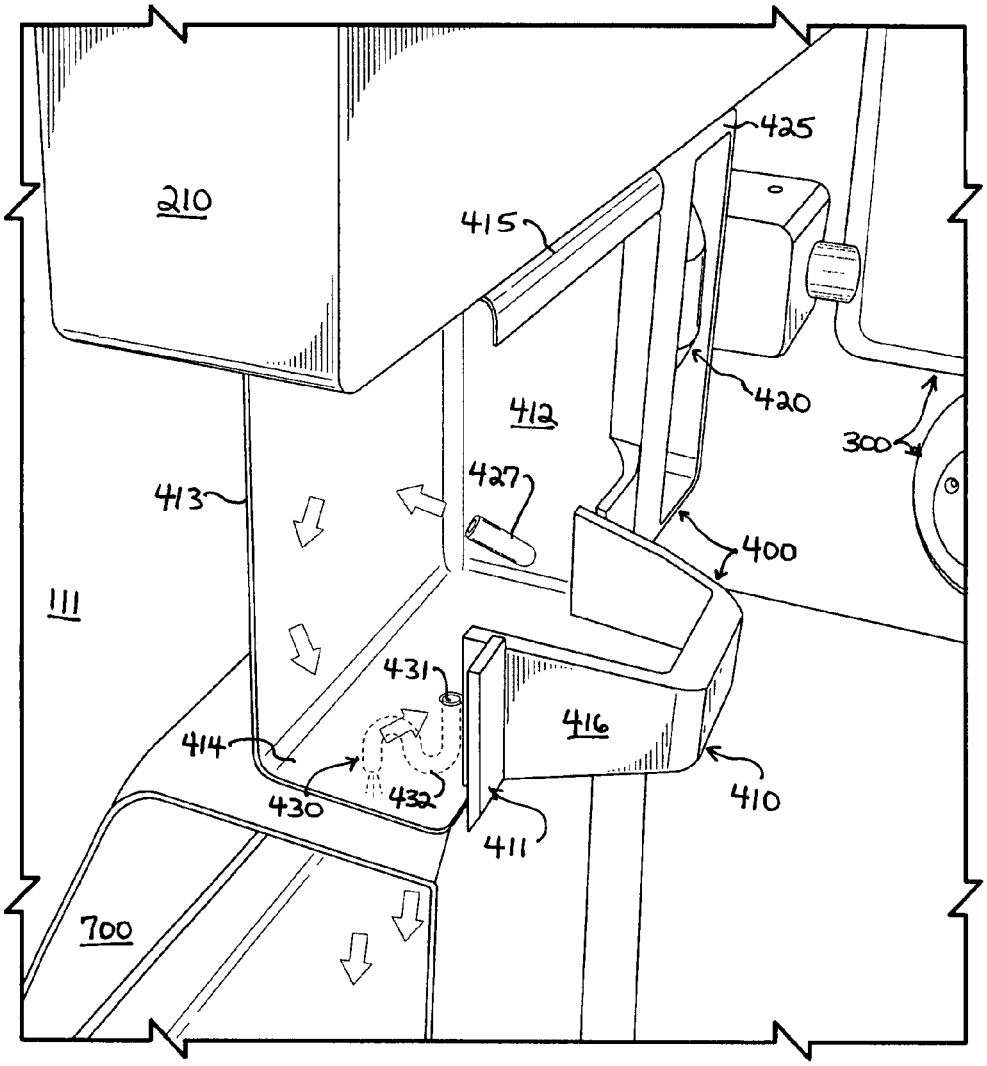
FIG. 6 is a prospective, partially sectioned, view of the urinal component of the embodiment of FIG. 1 showing the direction of water flow during a flush operation.

Referring now particularly to FIGS. 5 & 6, the urinal component 400 of the present invention 10 comprises a waste receiving unit 410 for receiving liquid waste, a flush means 420 for flushing or rinsing said receiving unit 410 after use by a patron, and a sanitary drain means 430 attached to said receiving unit 410 for channeling wastewater received and collected by said receiving unit 410 into the waste storage component 700 of the system 10. The urinal component 400 is situated along, and is rigidly attached to, one of the side walls 111 of the cabana structure 110 of said housing component 100 as shown and is supported by a portion of the waste storage component 700 of the system 10. Said urinal component 400 also provides structural support for the U-shaped tank member 210 of said water component 200 of said system 10. The waste receiving unit 410 of said urinal component 400 comprises an open-front rigid plastic receptacle 411 having a pair of side walls 412, a rear wall 413, a bottom portion 414 and a top portion 415. The bottom portion 414 of said receiving unit 410 further comprises a tray member 416 extending outwardly therefrom for facilitating the collection of liquid waste during patron use. The flush means 420 of said urinal component 400 comprises a hand-activated squeeze bulb 421 disposed within a housing 425 situated adjacent to said waste receiving unit 410. Said squeeze bulb 421 has a top end 422 and a bottom end 423 and receives water directly from the U-shaped tank 210 of the water component 200 through a water intake tube 424 attached at one end to said tank 210 and at the other end to the top end 422 of said squeeze bulb 421. Said intake tube 424 further comprises a one-way valve means 426 (detail not shown), situated within said intake tube 424, that allows water to enter said squeeze bulb 421 only after said bulb 421 has been squeezed and then released. A water discharge tube 427 is attached at one end to the bottom end 423 of said squeeze bulb 421 and extends through the squeeze bulb housing 425 and through one of the side walls 412 of said receiving unit 410 of said urinal component 400 as shown in FIGS. 5 & 6. The water discharge tube 427 extends slightly into the open-front receptacle 411 of said receiving unit 410 as shown and is directionally positioned so that water from said discharge tube 427 is directed at an upward angle against and along the rear wall 413 of said receiving unit 410. In operation, after a patron has deposited liquid waste into the receiving unit 410 of said urinal component 400 the patron squeezes the hand-activated squeeze bulb 421 thereby causing water contained in said bulb 421 to be discharged against and along the rear wall 413 of said receiving unit 410. The liquid waste deposited by a patron, and the flush or rinse water from said flush means 420, is thus collected and directed to the sanitary drain means 430 of said urinal component 400. Said drain means 430 comprises an opening 431 centrally positioned along the bottom portion 414 of the open-front receptacle 411 of the receiving unit 410 of said urinal component 400 to which is attached a sanitary siphon or "p-trap" type drain pipe assembly 432. Wastewater entering said drain means 430 is thereby directed into the waste storage component 700 of said system 10.

Figure 10:
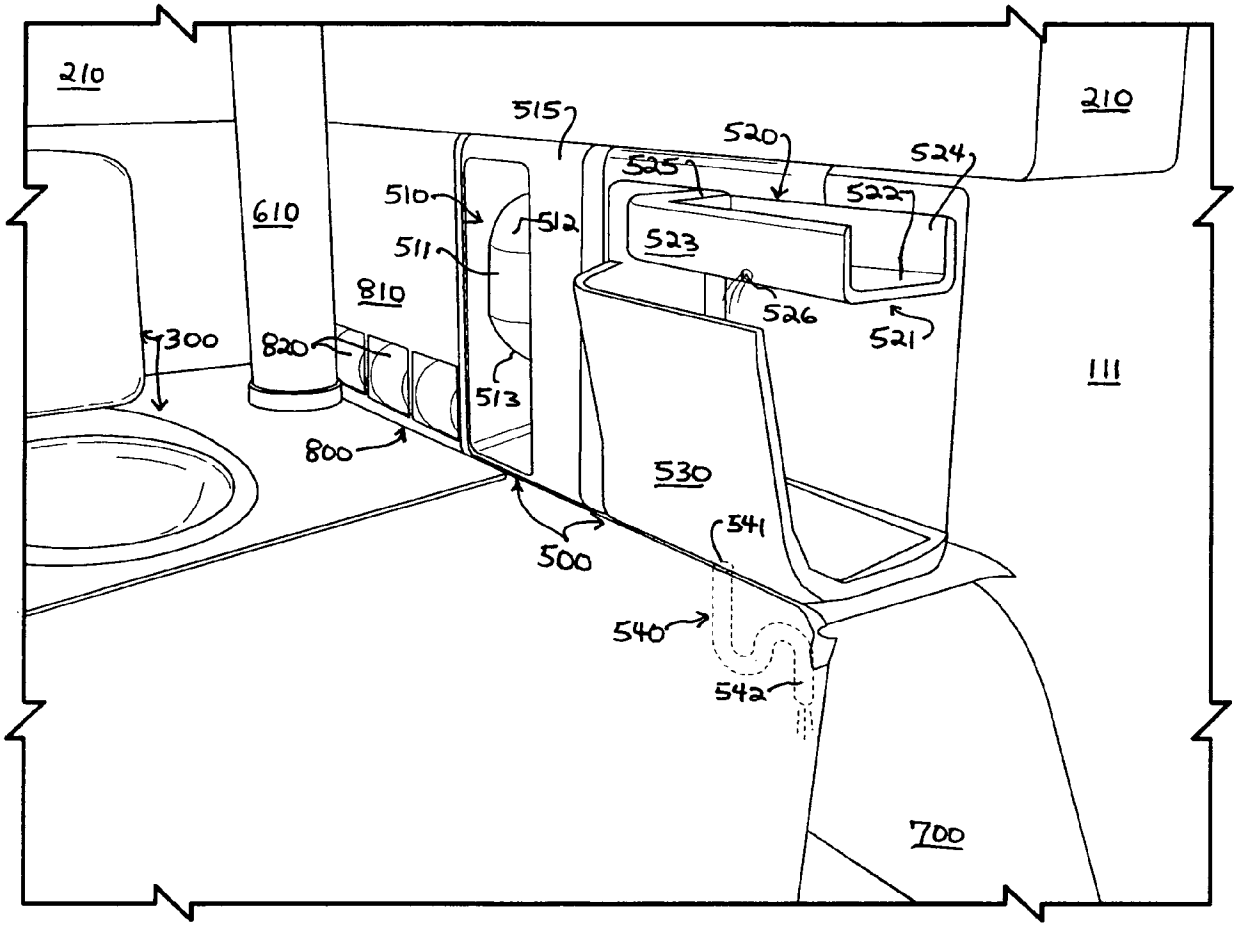
FIG. 10 is a perspective, partially sectioned, view of the lavatory component, the sanitary supply component, the waste storage component, and the septic vent pipe of the embodiment of FIG. 1.
Figure 11:
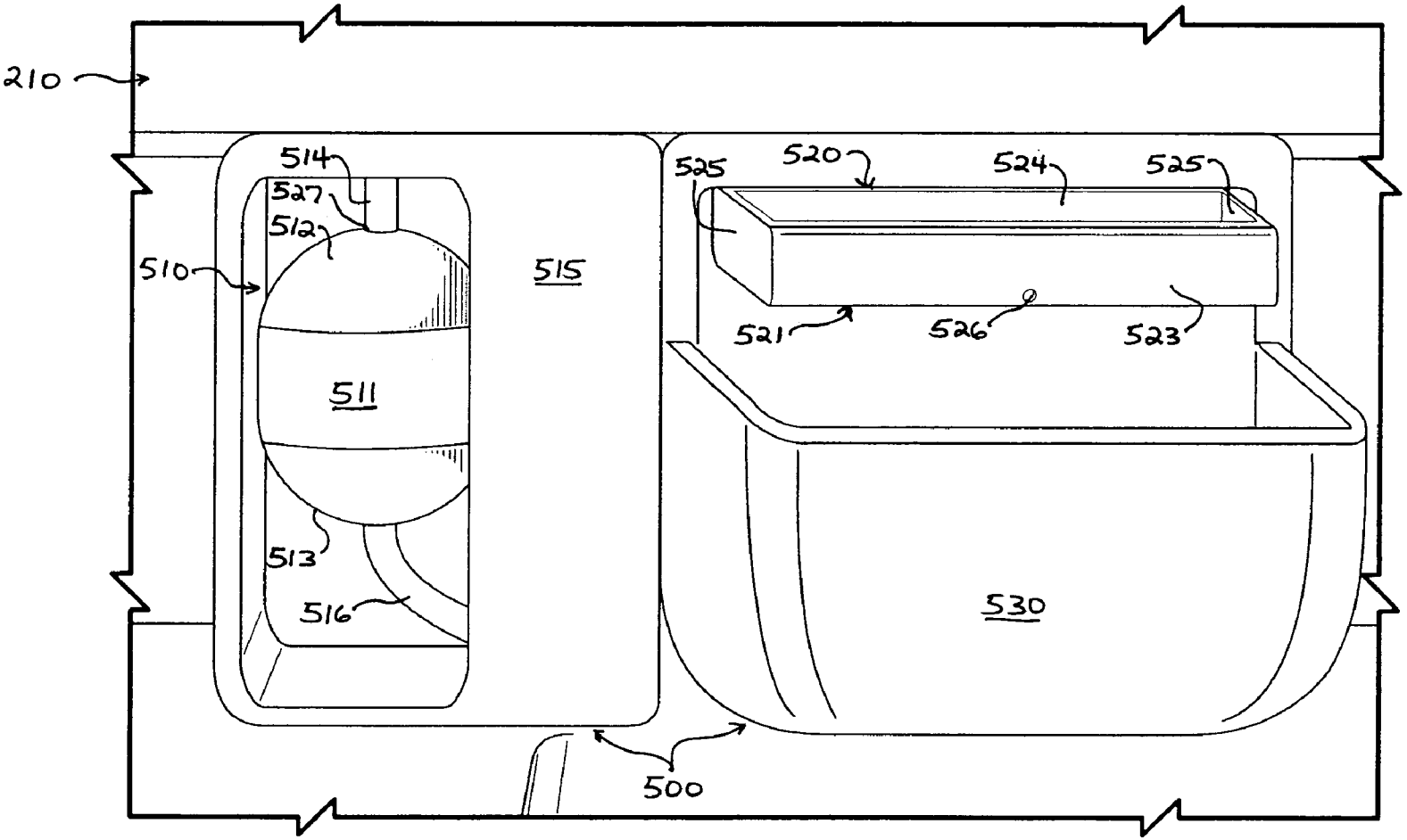
FIG. 11 is a perspective view of the lavatory component of the embodiment of FIG. 1.

Referring now to FIGS. 10 & 11, the lavatory component 500 of the present system 10 comprises a water supply means 510, an elevated water trough 520 operably connected to said water supply means 510, a washbasin or catch basin 530 positioned beneath said elevated water trough 520 and a sanitary drain means 540 attached to said catch basin 530. The lavatory component 500 is situated along, and is rigidly attached to, one of the side walls 111 of the cabana structure 110 of said housing component 100 as shown and is supported by a portion of the waste storage component 700 of the system 10. Said lavatory component 500 also provides structural support for the U-shaped tank member 210 of said water component 200 of said system 10. The water supply means 510 of said lavatory component 500 comprises a hand-activated squeeze bulb 511, similar to that used with the urinal component 400 of the system 10, disposed within a housing 515 situated adjacent to said elevated trough 520 and said catch basin 530. Said squeeze bulb 511 has a top end 512 and a bottom end 513 with the top end 512 being directly connected to the U-shaped tank member 210 of the water component 200 of the system 10 via a water intake tube 514 attached at one end to said tank member 210 and at the other end to the top end 512 of said squeeze bulb 511. Said water intake tube 514 further comprises a one-way valve means 527 (detail not shown), situated within said intake tube 514, that allows water to enter said squeeze bulb 511 only after said bulb 511 has been squeezed and then released. A water supply tube 516 is attached at one end to the bottom end 513 of said squeeze bulb 511 and extends through the squeeze bulb housing 515 and through said catch basin 530 to the elevated trough 520. Said elevated trough 520 comprises a shallow tray member 521 having a flat bottom 522, a front wall 523 and a rear wall 524 and two side walls 525. Water received by the elevated trough 520 from said water supply tube 516 is discharged from said trough 520 via a small discharge hole 526 centrally located along the front wall 523 of said trough 520. In operation, a patron would squeeze the hand-activated squeeze bulb 511 one or more times in order to pump water from said squeeze bulb 511 into said elevated trough 520 whereupon said water would be discharged from said trough 520 through the trough discharge hole 526 for hand washing. Water discharged from said trough 520 is collected in the catch basin 530 and is directed to the sanitary drain means 540. Said drain means 540 comprises an opening 541 centrally positioned along the bottom of said catch basin 530 to which is attached a sanitary siphon or "p-trap" type drain pipe assembly 542. Water entering said drain means 540 is thereby channeled directly to the waste storage component 700 of said system 10.

Referring now particularly to FIGS. 1 & 2, the septic vent component 600 of the present system 10 comprises a vertical vent pipe 610 extending from the waste storage component 700 of the system 10 through the interior of the housing component 100 of the system 10 and through the roof component 120 of said housing component 100 to a point above the venting means 130 of said roof component 120. Said vent component 600 allows gases formed within said waste storage system 700 to be vented directly to the atmosphere.

Referring again now to FIGS. 1 & 2, the waste storage component 700 of the present system 10 is constructed of rigid molded plastic and comprises a holding tank 710 in the shape of a modified, square-based, truncated pyramid. Said tank 710 comprising an essentially square base component 711, angular pyramidal walls 712 and a horizontal top component 713. The angular pyramidal walls 712 of said tank 710 extend vertically from said base component 711 and terminate at the edges of said horizontal top component 713 thereby forming a pyramidal plateau 714. The shape of the pyramidal tank 710 is modified along one of said angular walls 712 and along the surface of the pyramidal plateau 714 so as to create an inset or linear cove 715. The depth of said inset 715 is of sufficient dimensions so as to allow at least one person to stand or sit within the area created by said inset 715. Said inset 715 is shown in the drawings as being linear in construction, however, it will be understood that said inset 715 may also be non-linear in construction. The dimensions of the top component 713 of said holding tank 710, excluding the area removed by said inset 715, create sufficient surface area to accommodate and support the housing component 100 of the present system 10. The surface area of said top component 713 is also of sufficient dimensions to accommodate and support the detachable commode receptacle 311 of the commode component 300, the urinal component 400, and the lavatory component 500 of the system 10. An opening 701 for receiving and releaseably supporting the commode receptacle 311 of the commode component 300 is centrally positioned along the horizontal top component 713 of said holding tank 710 as shown.

As shown in FIGS. 1, 2 & 10, the sanitary supply component 800 of the present system 10 comprises a housing 810 for storing and dispensing sanitary products such as toilet paper. The housing 810 contains one or more openings 820 situated at or near the bottom of said housing 810 for accessing the sanitary products stored therein. Said sanitary supply component 800 is supported by a portion of the waste storage component 700 of the system 10 and also provides structural support for the U-shaped tank member 210 of said water component 200 of said system 10.

While the invention has been particularly shown and described with reference to the preferred embodiment thereof, it will be understood by those skilled in the art that various alterations in form, detail and construction may be made therein without departing from the spirit and scope of the invention.

The embodiments of the invention in which an exclusive property right or privilege is claimed are defined as follows:

1. A self-contained, portable, non-mechanical, waste disposal system comprises:

an enclosure having an entry door and having walls which support a roof component wherein said enclosure is of sufficient dimensions to accommodate at least one person in a standing or sitting position;

a means for storing water wherein said water storage means is attached to one or more walls of said enclosure;

a commode system, operably connected to said water storage means, for collecting and discharging human waste wherein said commode system employs a sanitary siphon in the discharge of said collected waste wherein said commode system comprises:

a commode component comprising an open receptacle for receiving human waste;

a commode supply tank, directly connected to said water storage means, for supplying water to said commode component during a waste discharge cycle wherein said commode supply tank comprises a flexible front wall;

a commode reservoir tank, operably connected to said commode component, for refilling said commode component with a predetermined amount of water after the initiation of a waste discharge cycle;

a flush valve assembly, operably disposed within said commode supply tank, for initiating a waste discharge cycle thereby causing a predetermine volume of water to flow from said commode supply tank to said commode component and to said commode reservoir, said flush valve assembly being operably attached to said flexible front wall of said commode supply tank, said flush valve assembly comprising:

an activator piston having a base component at one end and a pair of cone-shaped valve members at the opposing end, wherein said base component of said activator piston is attached to the flexible front wall of said supply tank;

a pair of supply pipes having open ends for simultaneously engaging the cone-shaped valve members of said activator piston and for supplying water to the commode component and to the commode reservoir, respectively; and, a means for venting said commode supply tank and for controlling the flow of water to said commode supply tank comprising:

a vent opening situated along the top of said commode supply tank;

a perforated housing attached to said vent opening; and, a buoyant sphere disposed within said perforated housing for closing said vent opening when the water level within said commode supply tank reaches a predetermined level;

a sanitary siphon attached to said commode component for channeling wastewater collected by said commode component directly into said waste storage means during a waste discharge cycle;

a urinal system, operably connected to said water storage means, for collecting and discharging liquid human waste wherein said urinal system employs a sanitary siphon in the discharge of said collected waste;

a lavatory system, operably connected to said water storage means, for providing clean water for hand or face washing and for collecting and discharging said water once used, wherein said lavatory system employs a sanitary siphon in the discharge of contaminated water;

a means for receiving and storing waste discharged from said commode system, said urinal system, and said lavatory system; and, a means for venting gases and odors from within said waste storage means directly into the atmosphere.

2. A self-contained, portable, non-mechanical. waste disposal system comprises:

an enclosure having an entry door and having walls which support a roof component wherein said enclosure is of sufficient dimensions to accommodate at least one person in a standing or sitting position;

a means for storing water wherein said water storage means is attached to one or more walls of said enclosure;

a commode system, operably connected to said water storage means, for collecting and discharging human waste wherein said commode system employs a sanitary siphon in the discharge of said collected waste;

a urinal system, operably connected to said water storage means, for collecting and discharging liquid human waste wherein said urinal system employs a sanitary siphon in the discharge of said collected waste wherein said urinal system comprises:

a urinal component comprising an open receptacle for receiving liquid human waste;

a means for providing water to said receptacle for rinsing said receptacle after use by a patron, wherein said means for providing water to said receptacle comprises:

a hand-activated squeeze bulb disposed adjacent to said open receptacle;

an intake tube attached to one end of said squeeze bulb for receiving water directly from said water storage means;

a one-way valve member disposed within said intake tube for allowing water to enter said bulb only after said bulb has been squeezed and released; and, a discharge tube attached to the opposing end of said squeeze bulb and extending from said bulb to the interior of said open receptacle;

a means for draining said receptacle; and, a sanitary siphon attached to said drain means for channeling liquid waste received by said urinal component directly into said waste storage means;

a lavatory system, operably connected to said water storage means, for providing clean water for hand or face washing and for collecting and discharging said water once used, wherein said lavatory system employs a sanitary siphon in the discharge of contaminated water;

a means for receiving and storing waste discharged from said commode system, said urinal system, and said lavatory system; and, a means for venting gases and odors from within said waste storage means directly into the atmosphere.

3. A self-contained. portable. non-mechanical, waste disposal system comprises:

an enclosure having an entry door and having walls which support a roof component wherein said enclosure is of sufficient dimensions to accommodate at least one person in a standing or sitting position;

a means for storing water wherein said water storage means is attached to one or more walls of said enclosure;

a commode system, operably connected to said water storage means, for collecting and discharging human waste wherein said commode system employs a sanitary siphon in the discharge of said collected waste:

a urinal system, operably connected to said water storage means. for collecting and discharging liquid human waste wherein said urinal system employs a sanitary siphon in the discharge of said collected waste:

a lavatory system, operably connected to said water storage means. for providing clean water for hand or face washing and for collecting and discharging said water once used, wherein said lavatory system employs a sanitary siphon in the discharge of contaminated water, and wherein said lavatory system comprises:

a catch basin;

an elevated trough positioned directly above said catch basin, said trough having an opening centrally positioned along the face of said trough:

a means for providing water to said elevated trough, wherein said means for providing water to said elevated trough comprises:

a hand-activated squeeze bulb disposed adjacent to said catch basin and said elevated trough;

an intake tube attached to one end of said squeeze bulb for receiving water directly from said water storage means;

a one-way valve member disposed within said intake tube for allowing water to enter said bulb only after said bulb has been squeezed and released; and, a discharge tube attached to the opposing end of said squeeze bulb and extending from said bulb to said elevated trough;

a means for draining said catch basin: and, a sanitary siphon, attached to said means for draining said catch basin, for channeling water collected by said catch basin directly into said waste storage means;

a means for receiving and storing waste discharged from said commode system, said urinal system. and said lavatory system; and, a means for venting gases and odors from within said waste storage means directly into the atmosphere.

* * * * *